US006666040B1

(12) United States Patent
Groenewold et al.

(10) Patent No.: US 6,666,040 B1
(45) Date of Patent: Dec. 23, 2003

(54) EFFICIENT WATER SOURCE HEAT PUMP WITH HOT GAS REHEAT

(75) Inventors: Peter Groenewold, Appleton, WI (US); Danny Hall, Jr., Mt. Pleasant, SC (US)

(73) Assignee: Desert Aire Corp., Milwaukee, WI (US)

( * ) Notice: Subject to any disclaimer, the term of this patent is extended or adjusted under 35 U.S.C. 154(b) by 20 days.

(21) Appl. No.: 10/189,296

(22) Filed: Jul. 2, 2002

(51) Int. Cl.[7] ..... F25B 27/00; F25B 29/00
(52) U.S. Cl. ..... 62/173; 62/238.6; 62/90
(58) Field of Search ..... 62/173, 238.6, 62/238.7, 177, 178, 179

(56) References Cited

U.S. PATENT DOCUMENTS

| | | | | |
|---|---|---|---|---|
| 1,837,798 A | | 12/1931 | Shipley | |
| 4,363,218 A | * | 12/1982 | Nussbaum | 62/79 |
| 4,653,287 A | | 3/1987 | Martin, Jr. | |
| 4,718,248 A | | 1/1988 | Fisher | |
| 4,796,437 A | | 1/1989 | James | |
| 5,239,838 A | | 8/1993 | Tressler | |
| 5,351,502 A | | 10/1994 | Gilles et al. | |
| 5,613,372 A | | 3/1997 | Beal et al. | |
| 5,682,754 A | | 11/1997 | Groenewold | |
| 5,752,389 A | | 5/1998 | Harper | |
| 6,055,818 A | | 5/2000 | Valle et al. | |
| 6,082,125 A | | 7/2000 | Savtchenko | |
| 6,381,970 B1 | | 5/2002 | Eber et al. | |

* cited by examiner

*Primary Examiner*—Chen-Wen Jiang
(74) *Attorney, Agent, or Firm*—Ryan Kromholz & Manion, S.C.

(57) ABSTRACT

A five element refrigeration system whereby heating and cooling functions of the system can be accomplished as in a reverse cycle system without needing to reverse the flow of the liquid through the system. The system comprises a refrigerant compressor, a pair of air side heat exchangers, an air blower to provide circulation for the air side heat exchangers, a pair of water side heat exchangers, and a reservoir to provide cooling water for the water side heat exchangers. The refrigerant compressor increases the pressure of a refrigerant flowing through it, causing it to circulate through the first air side heat exchanger, or a reheat coil. The refrigerant continues to the first water side heat exchanger, which acts as a condenser. In a cooling mode, the refrigerant continues to the second air side heat exchanger, which acts as an evaporator. In a heating mode, the refrigerant continues to the second water side heat exchanger, which acts as an evaporator. The reservoir water leaving the first water side exchanger is preheated when entering the second water side exchanger. The increase in the water temperature increases the efficiency of the system. Various valves are employed so that any or all of the heat exchangers may be bypassed in the operation of the system.

24 Claims, 8 Drawing Sheets

EFFICIENT WATER SOURCE HEAT PUMP WITH HOT GAS REHEAT

BACKGROUND OF THE INVENTION

This invention pertains to the art of refrigerating and heating systems, and, specifically, heat pump systems that use a liquid source as a thermal reservoir.

Refrigerant-based liquid water source heat pumps condition air by extracting heat energy from the liquid source or reservoir and transferring it to the conditioned air stream, or, in the opposite fashion, by extracting energy from the conditioned air stream and transferring it to the liquid. The liquid reservoir may be a groundwater loop, a heat pump loop, a pond, or a river.

Most heat pumps are known in the art as three element systems. That is, they consist of one or more refrigerant compressors, an air side heat exchanger, and a water side heat exchanger. When the conditioned air stream requires cooling and/or dehumidification, the air side coil functions as an evaporator. Refrigerant liquid circulating through the evaporator boils and absorbs energy from the air stream. The refrigerant compressor pumps the hot, energy-laden refrigerant to the water side heat exchanger, which functions as a condenser. The refrigerant gives up its energy to the body of water, and the process repeats until the cooling needs of the air stream are satisfied.

When the conditioned air stream requires heating, the water side heat exchanger functions as an evaporator. Refrigerant liquid circulating through the evaporator boils and absorbs energy from the body of water. The refrigerant compressor pumps the hot, energy-laden refrigerant to the air side heat exchanger, which functions as a condenser. The refrigerant gives up its energy to the air stream, and the process repeats until the heating needs of the air stream are satisfied.

Additionally, four element systems are also known in the art. A four element system is similar to a three element system, but with an additional air side heat exchanger. The additional heat exchanger is located downstream from the first air side heat exchanger. Often called a reheat coil, this additional coil functions as a condenser or desuperheater when the heat pump operates in the air dehumidification mode.

Whether a water source heat pump is a three element or four element system, most such systems use at least one refrigerant reversing valve to switch the system from the air heating to the air cooling mode of operation. Such systems are known as reverse cycle systems, and are quite common in the air conditioning field.

However, reverse cycle systems have several attributes that can hinder their reliability and energy efficiency. First, the air side and water side coils, or heat exchangers, must be capable of handling bi-directional refrigerant flow. Because an individual coil must function alternately as an evaporator or as a condenser, its design is a compromise.

For example, consider a typical air side coil functioning as a condenser. The majority of the refrigerant passing through its tubes exists either as a superheated vapor or a low quality liquid/vapor mixture. This mixture must flow with a velocity sufficient to "sweep" refrigeration oil back to the refrigerant compressor to ensure proper lubrication. When the system reverses and this same coil functions as an evaporator, the pressure drop of the refrigerant in the coil becomes much higher. This happens because the majority of the refrigerant passing through its tubes now exists as a subcooled liquid or a high quality liquid/vapor mixture.

Unfortunately, high evaporator pressure reduces the cooling capacity of a heat pump because its refrigerant compressor must work harder to overcome the friction between the liquid refrigerant and the tube walls of the evaporator coil. Although one can design a coil to reduce its refrigerant pressure loss when it functions as an evaporator, this same coil may not function well as a condenser. Its refrigerant velocity may then be insufficient to sweep lubricating oil back to the refrigerant compressor. In addition, refrigerant at low flow velocity tends to exhibit laminar rather than turbulent flow. This reduces its heat transfer capability. Finally, refrigeration oil tends to coat the inner walls of the coil, acting as a thermal insulator and further reducing heat transfer capability. High refrigerant velocities help "scrub" the coating of oil from the tube walls.

A second disadvantage of reverse cycle systems is that, like the coils, the internal refrigeration piping is the result of design compromises. Engineers select piping, valves, and refrigeration components that are small enough to minimize their cost yet large enough to prevent excessive refrigerant pressure losses. Pipes and components that handle refrigerant vapor are generally larger than those that handle only liquid. However, in a reverse cycle system, engineers must usually size components in a manner that they can conduct both liquid and vaporized refrigerant. This becomes even more difficult when a refrigeration system is subject to unloading, where it is made to operate at a reduced capacity to match a partial heating or cooling load.

Furthermore, refrigerant compressors can be damaged in traditional reverse cycle heat pumps when the system shifts from the air heating to the air cooling mode or vice-versa. This happens when a condenser suddenly becomes an evaporator, and the liquid refrigerant that collected in its final circuits is abruptly sucked into the crankcase of the refrigerant compressor. This liquid, which can be an effective solvent, displaces oil in the bearings of the refrigerant compressor, which could seize or damage the bearings. To prevent refrigerant compressor damage, most reverse cycle heat pumps are equipped with suction accumulators, large tanks designed to safely contain the slug of liquid refrigerant that occurs during system shifts.

Not only can the refrigerant compressors be damaged when the system shifts between a heating mode and a cooling mode, but the piping may be damaged as well. This happens when an evaporator suddenly becomes a condenser, and the liquid refrigerant that collected in its initial circuits is abruptly hit with hot discharge vapor from the refrigerant compressor. This causes violent expansion as a portion of the liquid refrigerant flashes into a vapor. In extreme cases, refrigerant piping may become fatigued or even rupture due to the force unleashed by this process.

SUMMARY OF THE INVENTION

The present invention presents a novel, non-reversible refrigerating and heating system that minimizes the disadvantages of the prior art while also having several advantages over the prior art. First, because it is not a reverse cycle system, it does not have the same risk of piping damage or refrigerant compressor bearing seizure when the system shifts from an air heating to an air cooling mode, or vice-versa. This invention does not require some of the specialized components that many reverse cycle systems use, such as suction accumulators, reversing valves, or bi-directional refrigerant filters.

Also, this invention operates more efficiently than existing art because its heat exchangers can be optimized for their intended function. For example, the air side evaporator coil of this invention can be designed specifically for high moisture removal without performance degradations caused by reverse-flow considerations. The reheat condenser can function efficiently during both summer and winter heating operations because it is designed and functions solely as a reheat condenser.

Moreover, the novel series arrangement of the water side heat exchangers permits more efficient heat extraction during air heating modes of operation. Because the water condenser is the upstream water side heat exchanger, it preheats the incoming water with any excess energy not required by the reheat coil. Preheating the water enables the downstream water evaporator to more efficiently absorb energy from that water. This is true because warmer water permits the refrigerant compressor to operate at a higher evaporating pressure, which increases the energy efficiency of the refrigerant compressor.

An additional benefit of this invention when used in a heat pump loop system is that it only extracts as much energy from the water loop as is needed to maintain proper air heating. Any excess energy is returned by the system to the loop water for use by other equipment served by the heat pump loop.

A yet additional benefit of the series arrangement of heat exchangers is that preheating the water may eliminate the need for antifreeze in certain applications. Quality antifreeze is expensive to purchase, and its use mandates additional, expensive water-to-antifreeze heat exchangers when the water source requires environmental contact.

An object of the present invention is to provide a device for controlling the quality of the air leaving the device with high efficiency and precision.

The invention introduces a novel five element refrigeration system whereby heating and cooling functions of the system can be accomplished as in a reverse cycle system without needing to reverse the flow of the liquid through the system.

The system comprises a refrigerant compressor, a pair of air side heat exchangers, an air blower to provide circulation for the air side heat exchangers, a pair of water side heat exchangers, and a reservoir to provide cooling water for the water side heat exchangers. In a preferred embodiment, the refrigerant compressor increases the pressure of a refrigerant flowing through the compressor, causing it to circulate through the first air side heat exchanger, or a reheat coil. The refrigerant continues to the first water side heat exchanger, which acts as a condenser. In a cooling mode, the refrigerant continues to the second air side heat exchanger, which acts as an evaporator. In a heating mode, the refrigerant continues to the second water side heat exchanger, which acts as an evaporator.

Because the system can function either in heating or cooling mode utilizing different components, the system does need extraneous peripheral components, such as suction accumulators, reversing valves, or bi-directional refrigerant filters, to operate. Likewise, the series arrangement of the water side heat exchangers allows a more efficient operation of the system. The reservoir water leaving the first water side exchanger is preheated when entering the second water side exchanger. The increase in the water temperature increases the efficiency of the system.

Alternatively, a second embodiment of the five element system operates without the water side heat exchangers arranged in series. As the refrigerant leaves the first water side heat exchanger, it progresses through the piping to either the second water side heat exchanger or the second air side heat exchanger depending on whether the system is performing a cooling or heating function. In this embodiment, the second water side heat exchanger absorbs water from a warm water source, thereby supplying heat into the system.

Within either system, various valves are employed so that any or all of the heat exchangers may be bypassed in the operation of the system. The following detailed description will further describe the novelty of the invention.

DETAILED DESCRIPTION

Although the disclosure hereof is detailed and exact to enable those skilled in the art to practice the invention, the physical embodiments herein disclosed merely exemplify the invention that may be embodied in other specific structures. While the preferred embodiment has been described, the details may be changed without departing from the invention, which is defined by the claims.

Figure 1:
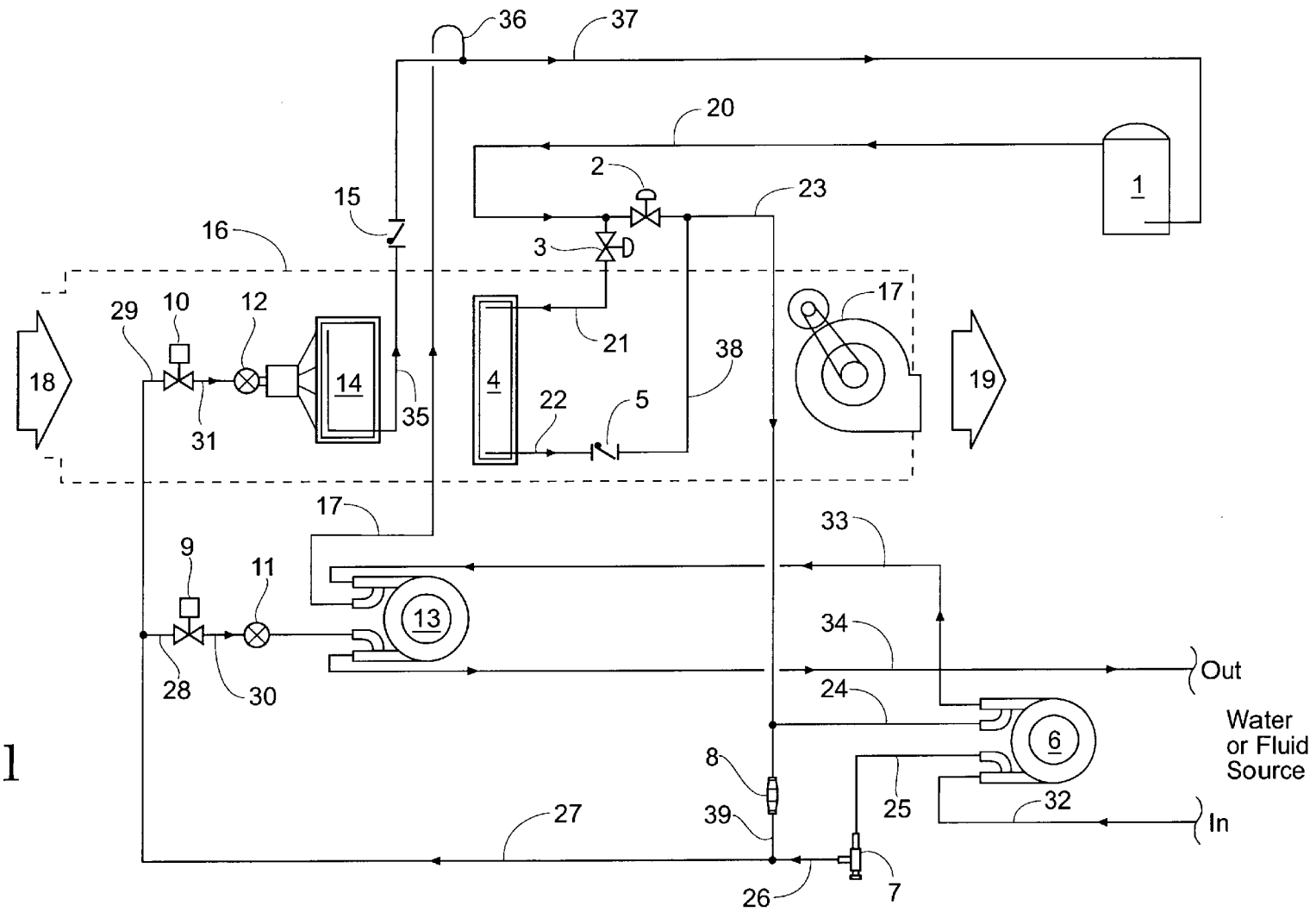
FIG. 1 is a diagrammatic view of the present invention utilizing water side heat exchangers in series arrangement.

FIG. 1 shows a schematic view of the present invention operating with water side heat exchangers in a series arrangement. In a first embodiment of this five element system, the system consists of three separate fluid flow loops; an air flow loop, a liquid flow loop, and a refrigerant flow loop. A refrigerant compressor 1 increases the pressure, and thereby the temperature of a refrigerant vapor, causing it to circulate throughout the refrigeration system. A valve 3 regulates the flow of hot vapor to a reheat coil 4. The valve 3 can be a manual stop valve, an electromagnetic solenoid, a pneumatically- or electrically responsive valve, or any regulating means known to those skilled in the art. This valve 3 acts to maintain the temperature or heating needs of a conditioned air stream. Although the inlet of the reheat coil 4 is shown connected to the outlet of the valve 3, the connection is one of a plurality of arrangements that will permit successful operation of the invention.

Regardless of the arrangement, at least a portion of the refrigerant then flows through a valve 2 to a first water side heat exchanger or the water cooled condenser 6. The valve 2 serves to maintain sufficient back pressure to force the vaporized refrigerant through the reheat coil 4. The valve 2 can be a spring-loaded check valve, a differential pressure regulator, an electromagnetic solenoid, a pneumatically- or electroresponsive valve, or any regulating means known to those proficient in the art. The refrigerant transfers a portion of its energy to the cooling fluid, which may be from a heat pump loop, a swimming pool, a groundwater source, or any suitable reservoir of fluid.

Still referring to FIG. 1, a pair of refrigerant pressure control valves, or head pressure control valves 7 and 8, facilitates the flow of the refrigerant through and past the first water side heat exchanger, or the water cooled condenser 6. The valves 7 and 8 are ORI and ORD valves, respectively, manufactured by Sporlan Valve Company of Washington, Mo. Alternatively, the head pressure control means may consist of similar valves made by other manufacturers, pressure-responsive water regulating valves, or any means known by those skilled in the art to control the discharge pressure of a refrigeration system. The control valves 7 and 8 serve to ensure that the refrigerant vapor diverted to the reheat coil 4 has sufficient temperature to transfer heat to the conditioned air stream.

When the vaporized refrigerant transfers its energy to the reheat coil 4 and/or the first water side heat exchanger or the water cooled condenser 6, the refrigerant condenses to its liquid state. As the liquid refrigerant circulates, stop valves 9 and 10 control the flow of the refrigerant to the evaporator coils, or heat exchangers, 13 and 14, respectively. When the conditioned air stream requires cooling and/or dehumidification, the stop valve 10 opens to permit liquid refrigerant to flow to the air side heat exchanger or air cooled evaporator 14. A restrictor 12 lowers the pressure and temperature of the liquid refrigerant, permitting it to vaporize and absorb energy from the conditioned air stream. The restrictor 12 may be a hand valve, a capillary tube, an expansion valve, or any means known to depressurize refrigerant.

When the conditioned air stream requires heating, the stop valve 9 opens to permit the liquid refrigerant to flow to the second water side heat exchanger or the water cooled evaporator 13. A restrictor 11 lowers the pressure and temperature of the liquid refrigerant, permitting it to vaporize and absorb energy from the cooling fluid exiting the first water side heat exchanger or the water cooled condenser 6. The restrictor 11 is of similar design as the above restrictor 12. The refrigerant vapor is then returned to the refrigerant compressor 1 and the cycle continues until the need for conditioned air has been satisfied.

An air flow path is represented by entering unconditioned air 18 and exiting conditioned air 19. An air blower 17 provides conditioned air circulation through the reheat coil 4 and the air side heat exchanger or air cooled evaporator 14. A broken line is used (FIGS. 1–8) to indicate the housing member for the system.

Figure 2:
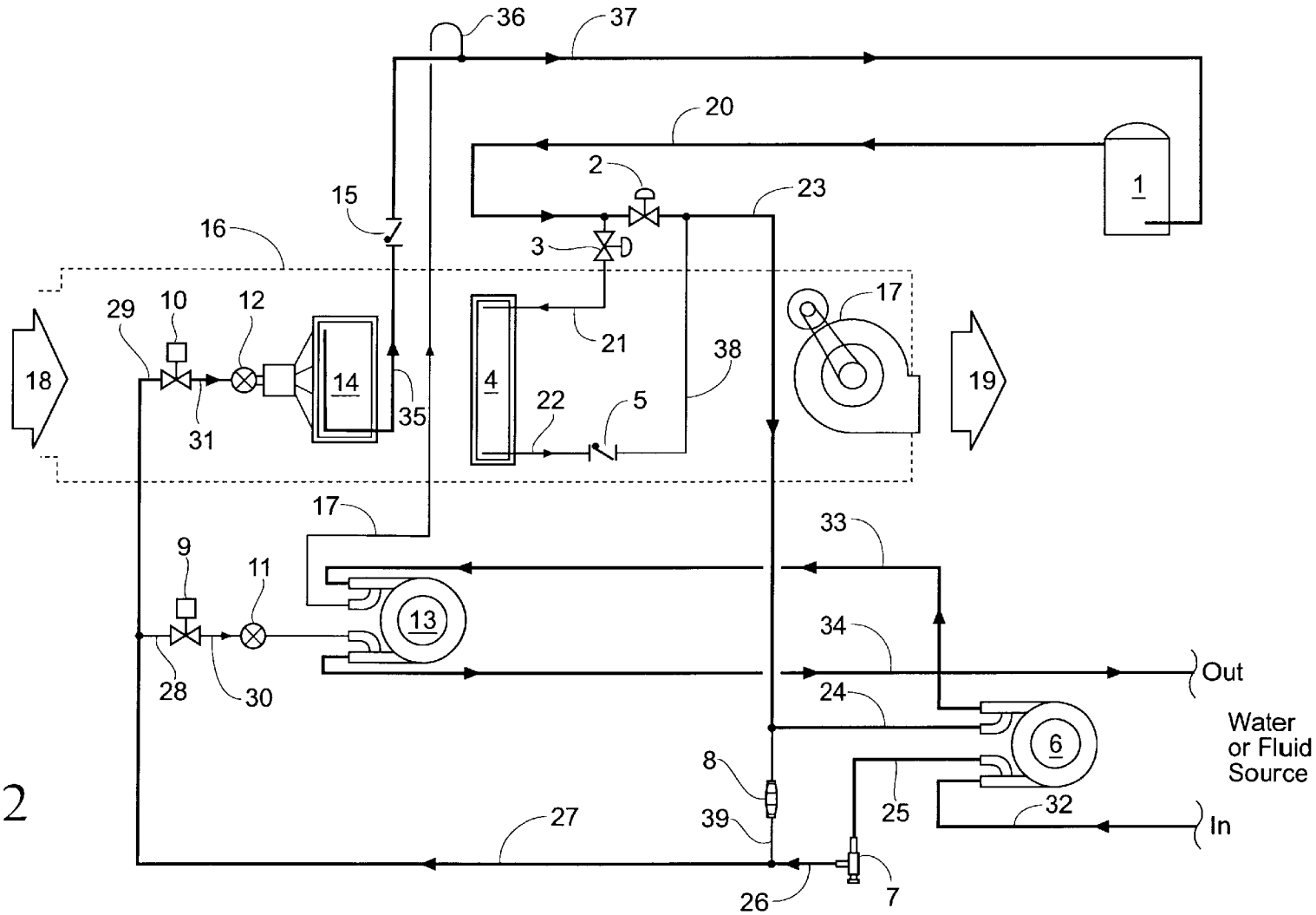
FIG. 2 is a diagrammatic view of the invention in FIG. 1 in an air cooling mode.

Referring specifically to FIG. 2, the arrangement of FIG. 1 is shown operating in an air cooling mode. As the refrigerant leaves the refrigerant compressor 1, the valve 3 closes to allow the refrigerant to bypass the reheat coil 4 and pass through the valve 2 towards the first water side heat exchanger or the water cooled condenser 6. The first water side heat exchanger 6 condenses the refrigerant from the vapor to the liquid form. The liquid refrigerant then flows out of the first water side heat exchanger 6 along path 25, through the head pressure control valve 7, and then along path 26 to path 27. Since the system is in a cooling mode, the stop valve 9 prevents the refrigerant from entering the second water side heat exchanger or the water cooled evaporator 13. The refrigerant then travels down path 29 to the open stop valve 10 and is caused by the restrictor 12 to boil inside air side heat exchanger or air cooled evaporator 14. The unconditioned air 18 passes through the heat exchanger 14 and is cooled prior to being distributed as the conditioned air 19 by the air blower 17.

Still referring to FIG. 2, the water for operating the first water side heat exchanger, or the water cooled condenser 6, enters the system along path 32. The water leaves the heat exchanger 6 along path 33 at an elevated temperature. The water then enters the second water side heat exchanger or the water cooled evaporator 13 and exits the heat exchanger 13 along path 34 back to the water source, allowing for more energy to be returned to the water source for other cooling purposes.

Figure 3:
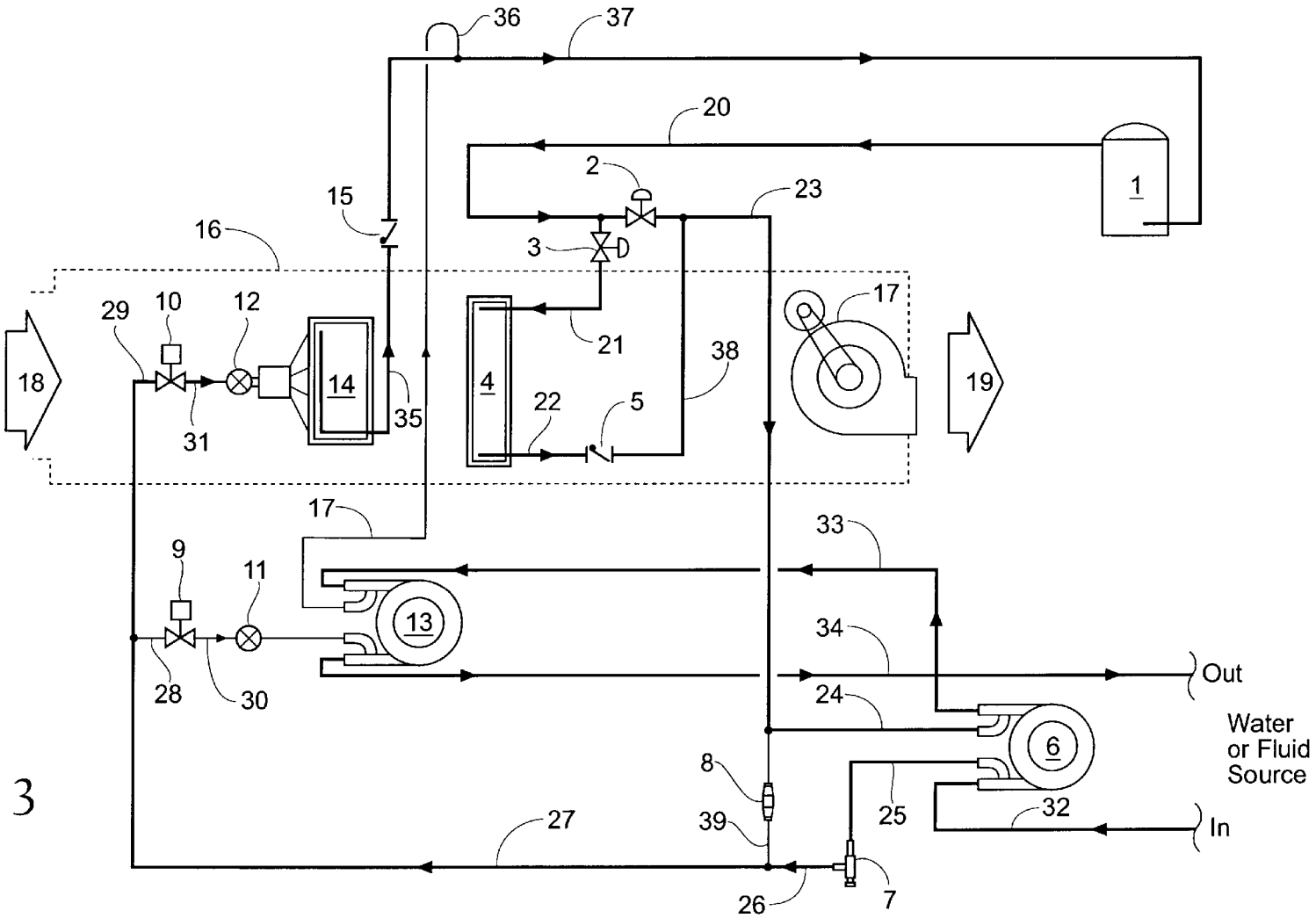
FIG. 3 is a diagrammatic view of the invention in FIG. 1 in a dehumidifying mode.

FIG. 3 depicts the system of FIG. 1 in an air dehumidifying mode. As refrigerant vapor leaves the refrigerant compressor 1, the valve 3 opens to permit a partial flow of the hot refrigerant vapor to the reheat coil 4. The partial flow of the refrigerant recombines with the remaining refrigerant vapor that bypassed the reheat coil 4 and passed directly through the valve 2. The refrigerant then flows to the first water side heat exchanger or the water cooled condenser 6 where the refrigerant condenses to its liquid form. The liquid refrigerant flows through the open valve 10 where the restrictor 12 causes the refrigerant to boil inside the air side heat exchanger or air cooled evaporator 14. The unconditioned air 18 passes through the heat exchanger 14 and is cooled and dehumidified. The reheat coil 4 then reheats the cool air prior to the air being distributed as the conditioned air 19 by the blower 17.

Figure 4:
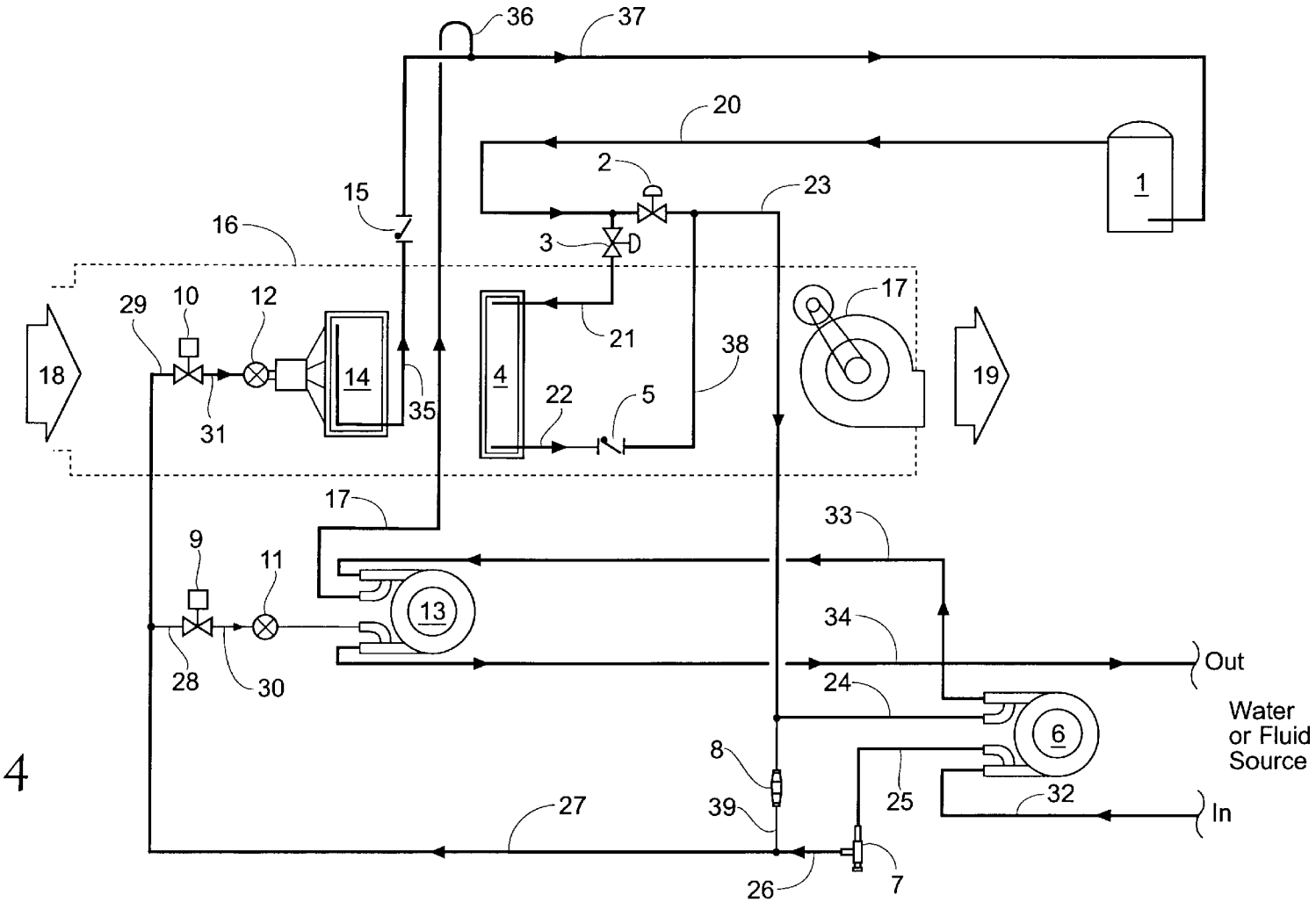
FIG. 4 is a diagrammatic view of the invention in FIG. 1 in an air heating mode.

FIG. 4 depicts the system of FIG. 1 in an air heating mode. The refrigerant flows in the same fashion from the refrigerant compressor 1 to the first water side heat exchanger or the water cooled condenser 6 as shown in FIG. 3. However, when the liquid refrigerant leaves the first water side heat exchanger or the water cooled condenser 6 the stop valve 10 is shut and the refrigerant now flows through the open stop valve 9. The restrictor 11 causes the refrigerant to boil inside the water side heat exchanger 13. The reheat coil 4 then reheats the unconditioned air 18 prior to the air being distributed as the conditioned air 19 by the blower 17.

Because the water used for cooling the second water side heat exchanger 13 has already passed through the first water side heat exchanger 6, there is less of a temperature difference between the water and the refrigerant. The result is that the refrigerant reentering the refrigerant compressor 1 has a higher temperature, which permits the refrigerant compressor 1 to operate at a higher evaporating pressure, thereby increasing its operating efficiency, and thereby lowering the operating costs of the present novel system.

As the refrigerant leaves the second water side heat exchanger or the water cooled evaporator 13, the refrigerant crosses the path of the unconditioned air 18. The reheat coil 4 then reheats the cool air prior to the air being distributed as the conditioned air 19 by supply blower 17.

FIGS. 5–8 depict a second embodiment of the present invention. The second embodiment contains the same elements as the first embodiment shown in FIGS. 1–4, inclusive, except now a separate loop conducts warm fluid to the second water side heat exchanger or the water cooled evaporator 13, and a separate loop conducts cool fluid to the first water side heat exchanger or the water cooled condenser 6.

Figure 5:
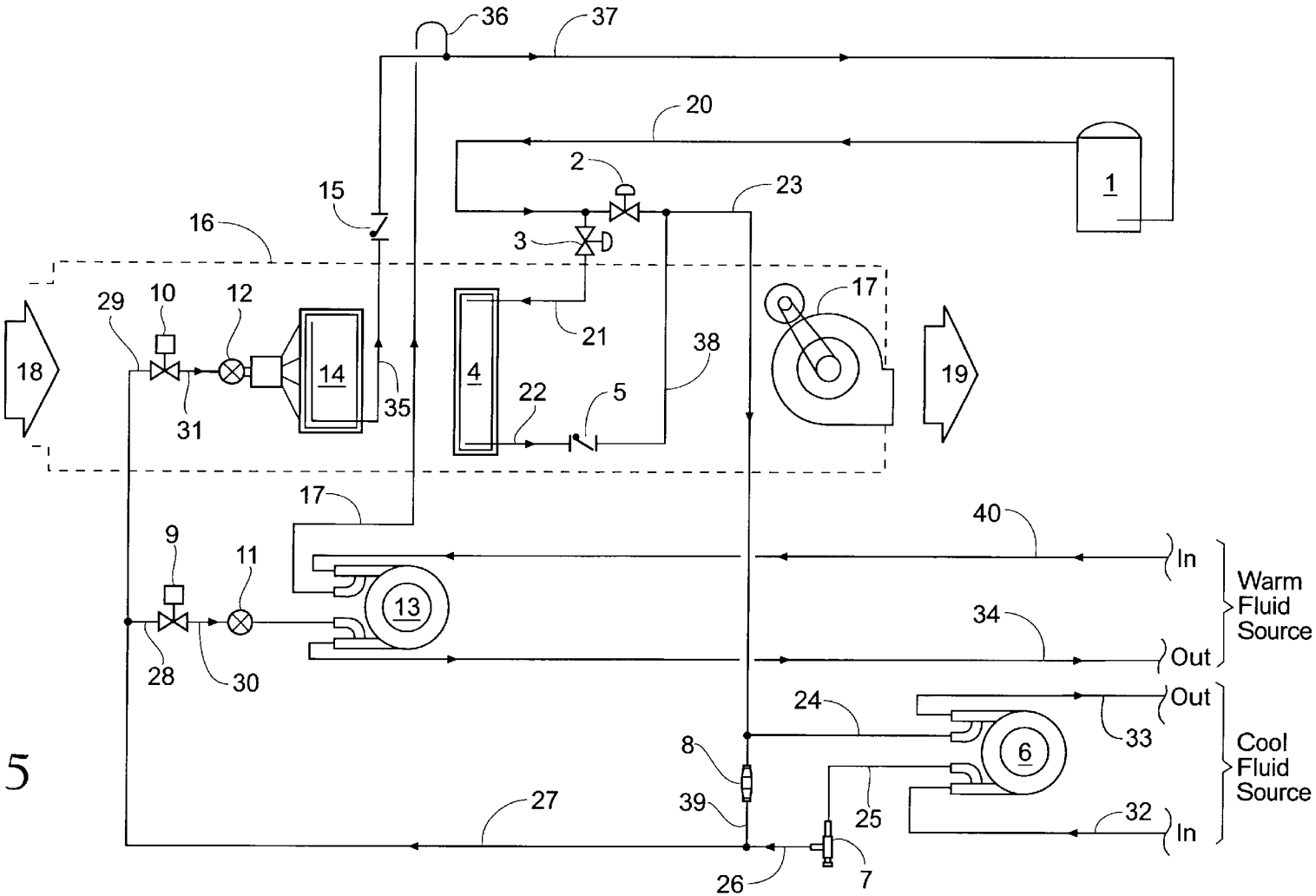
FIG. 5 is a diagrammatic view of the present invention with the water side heat exchangers operating with separate water sources.
Figure 6:
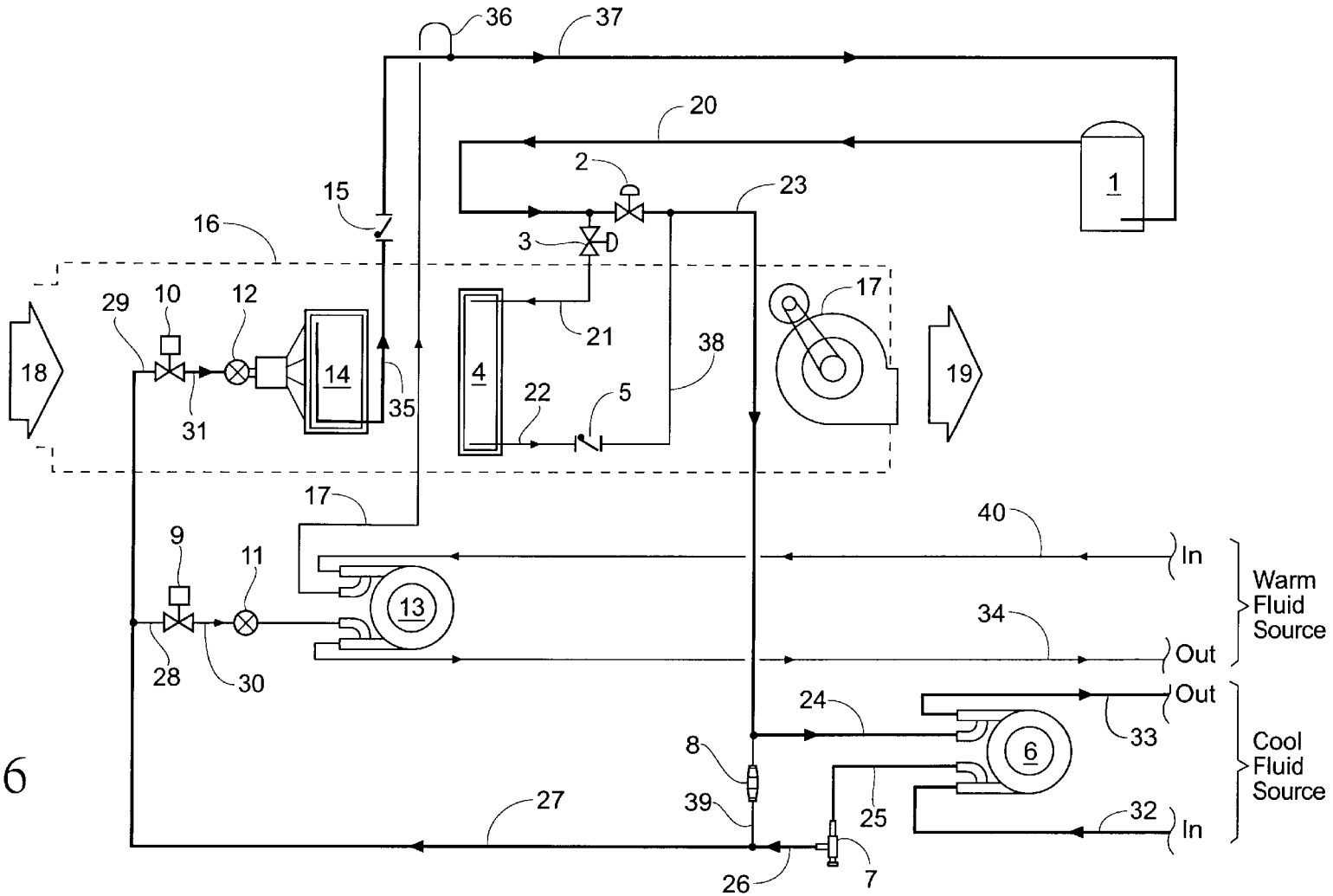
FIG. 6 is a diagrammatic view of the invention in FIG. 4 in an air cooling mode.

Referring specifically to FIG. 6, the arrangement of FIG. 5 is shown operating in an air cooling mode. As the refrigerant leaves the refrigerant compressor 1, the valve 3 closes to allow the refrigerant to bypass the reheat coil 4 and pass through the valve 2 towards the first water side heat exchanger or the water cooled condenser 6. The first water side heat exchanger 6 condenses the refrigerant from the vapor to the liquid form. The liquid refrigerant then flows out of the first water side heat exchanger 6 along path 25, through the head pressure control valve 7, and then along path 26 to path 27. Since the system is in a cooling mode, the stop valve 9 prevents the refrigerant from entering the second water side heat exchanger or the water cooled evaporator 13. The refrigerant then travels down path 29 to the open stop valve 10 and is caused by the restrictor 12 to boil inside the air side heat exchanger or air cooled evaporator 14. The unconditioned air 18 passes through the heat exchanger 14 and is cooled prior to being distributed as the conditioned air 19 by the air blower 17.

Figure 7:
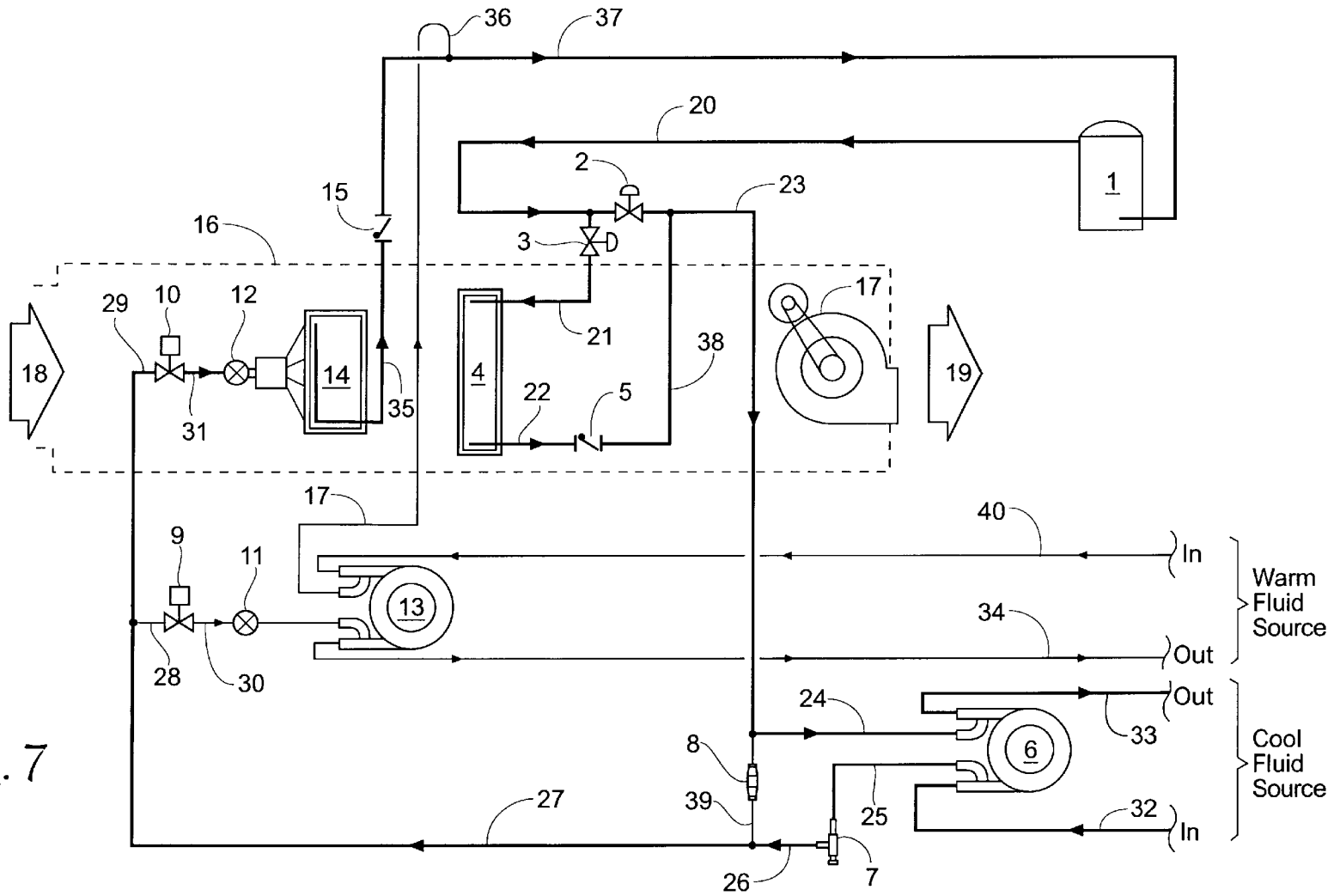
FIG. 7 is a diagrammatic view of the invention in FIG. 4 in a dehumidifying mode.

FIG. 7 depicts the second embodiment in an air dehumidifying mode. As refrigerant vapor leaves the refrigerant compressor 1, the valve 3 opens to permit a partial flow of the hot refrigerant vapor to the reheat coil 4. The partial flow of the refrigerant recombines with the remaining refrigerant vapor that bypassed the reheat coil 4 and passed directly through the valve 2. The refrigerant then flows to the first water side heat exchanger or the water cooled condenser 6 where the refrigerant condenses to its liquid form. The liquid refrigerant flows through the open valve 10 where the restrictor 12 causes the refrigerant to boil inside the air side heat exchanger or air cooled evaporator 14. The unconditioned air 18 passes through the heat exchanger 14 and is cooled and dehumidified. The reheat coil 4 then reheats the cool air prior to the air being distributed as the conditioned air 19 by supply blower 17.

Because the second water side heat exchanger or the water cooled evaporator 13 is not needed in the air cooling and dehumidifying modes shown in FIGS. 6 and 7, respectively, the system does not use unnecessary energy, and, thus, has an increased efficiency.

Figure 8:
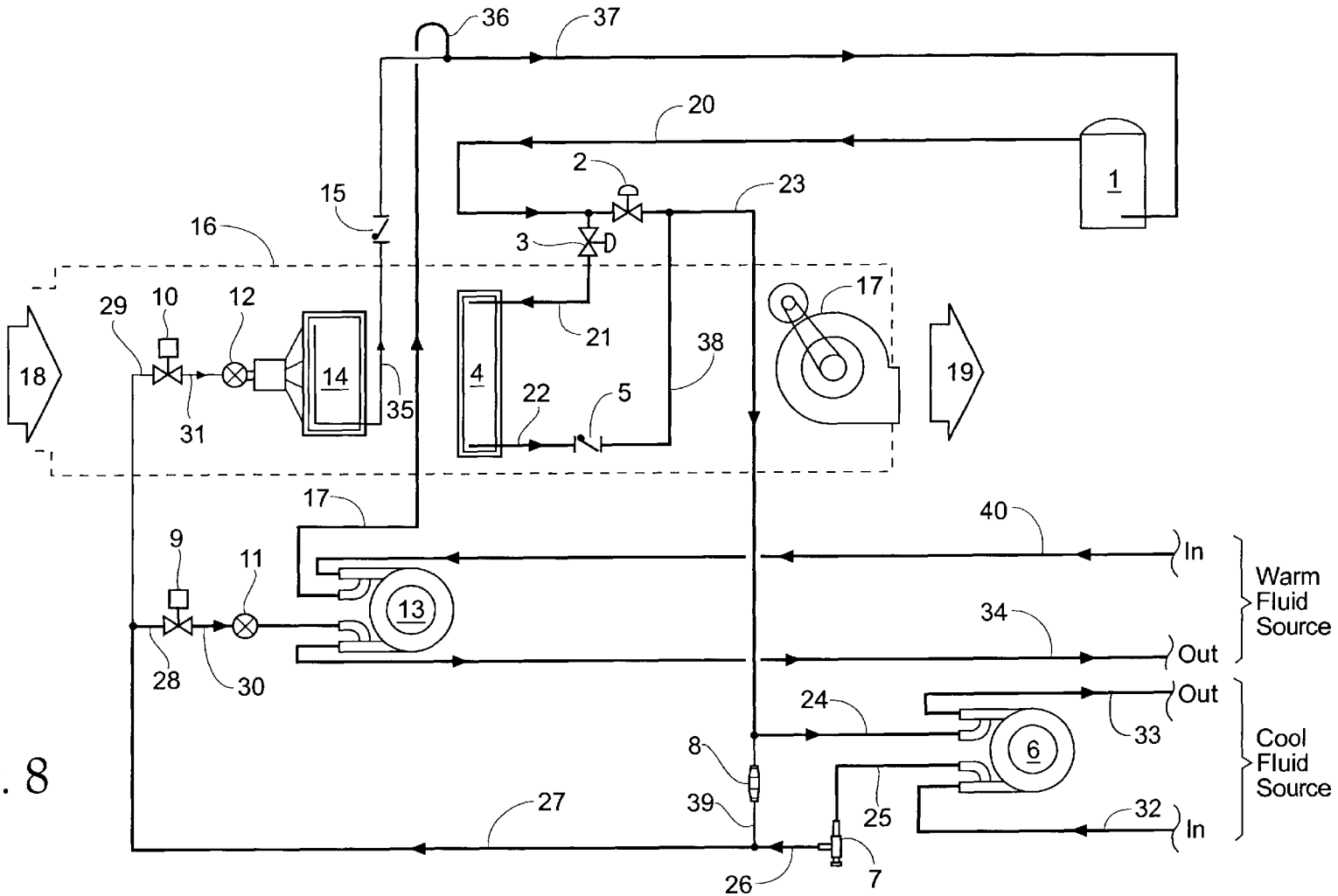
FIG. 8 is a diagrammatic view of the invention in FIG. 4 in an air heating mode.

FIG. 8 depicts the second embodiment in an air heating mode. The refrigerant flows in the same fashion from the refrigerant compressor 1 to the first water side heat exchanger or the water cooled condenser 6 as shown in FIG. 3. However, when the liquid refrigerant leaves the first water side heat exchanger or the water cooled condenser 6 the stop valve 10 is shut and the refrigerant now flows through the open stop valve 9. The restrictor 11 causes the refrigerant to boil inside the water side heat exchanger 13. The boiling refrigerant absorbs energy from the heated water source 34 entering the heat exchanger 13. The unconditioned air 18 passes through the reheat coil 4 and is heated prior to being distributed by the air blower 17 as the exit conditioned air 19.

The above described embodiments of this invention are merely descriptive of its principles and are not to be limited. For instance, the system is described with five elements, but the system could operate with multiple air and water side heat exchangers and still be within the scope of the invention. Likewise, though the system uses water as a source for the water side heat exchangers, any suitable liquid could be employed. The scope of this invention instead shall be determined from the scope of the following claims, including their equivalents.

What is claimed is:

1. An improved refrigeration system using a refrigerant to transfer heat between air and a liquid, comprising:

a primary refrigerant loop including:

a refrigerant compressor, said refrigerant compressor having a suction refrigerant inlet and a compressed refrigerant outlet;

a reheat coil, said reheat coil having a refrigerant inlet and a refrigerant outlet;

a flow-throttling valve, said flow-throttling valve located between said refrigerant compressor outlet and said reheat coil inlet;

a first liquid side heat exchanger, said first liquid side heat exchanger having a refrigerant inlet and a refrigerant outlet, a liquid inlet, and a liquid outlet;

a second flow-throttling valve, said second flow-throttling valve located between said refrigerant compressor outlet and said first liquid side heat exchanger refrigerant inlet;

a head pressure control valve, said head pressure control valve capable of maintaining the outlet pressure of said refrigerant compressor above a desired limit;

a second liquid side heat exchanger, said second liquid side heat exchanger having a refrigerant inlet and a refrigerant outlet, a liquid inlet and a liquid outlet;

a first restrictor means, said first restrictor means regulating the flow of said refrigerant to said second liquid side heat exchanger;

an air side heat exchanger, said air side heat exchanger having a refrigerant inlet and a refrigerant outlet; and a second restrictor means, said second restrictor means regulating the flow of said refrigerant to the air side heat exchanger; and a secondary liquid loop including:

said first liquid side heat exchanger, said liquid outlet of said first liquid side heat exchanger communicating with said liquid inlet of said second liquid side heat exchanger.

2. The system of claim 1 wherein the reheat coil and the air side heat exchanger are enclosed within a housing means.

3. The system of claim 2, wherein the housing means comprises an air blower, said air blower allowing for an air supply to flow over the air side heat exchanger and the reheat coil.

4. The system according to claim 3, wherein the air supply exiting the system has a higher temperature than the air supply entering the system.

5. The system according to claim 3, wherein the air supply exiting the system has a lower temperature than the air supply entering the system.

6. The system according to claim 3, wherein the air supply exiting the system is less humid than the air supply entering the system.

7. The system according to claim 1, wherein the inlet of said first liquid side heat exchanger communicates with a cool liquid source.

8. The system according to claim 1 wherein the outlet of said second liquid side heat exchanger communicates with a cool liquid source.

9. In an improved system using a refrigerant to transfer heat between air and a liquid, comprising:

a refrigerant compressor;

said refrigerant compressor having a suction refrigerant inlet and a compressed refrigerant outlet, a reheat coil, said reheat coil having a refrigerant inlet and a refrigerant outlet;

a first liquid side heat exchanger, said first liquid side heat exchanger having a refrigerant inlet and a refrigerant outlet, a liquid inlet, and a liquid outlet;

an air side heat exchanger, said air side heat exchanger having a refrigerant inlet and a refrigerant outlet; and a first restrictor means, said first restrictor means regulating the flow of said refrigerant to the air side heat exchanger, the improvement comprising:

a second liquid side heat exchanger, said second liquid side heat exchanger having a liquid inlet and a liquid outlet, said second liquid side heat exchanger being arranged in a serial fashion with said first liquid side heat exchanger whereby the liquid outlet of said first liquid side heat exchanger communicates with the liquid inlet of said second liquid side heat exchanger.

10. The system of claim 9 wherein the reheat coil and the air side heat exchanger are enclosed within a housing means.

11. The system of claim 10, wherein the housing means comprises an air blower, said air blower allowing for an air supply to flow over the air side heat exchanger and the reheat coil.

12. The system according to claim 10, wherein the air supply exiting the system has a higher temperature than the air supply entering the system.

13. The system according to claim 10, wherein the air supply exiting the system has a lower temperature than the air supply entering the system.

14. The system according to claim 10, wherein the air supply exiting the system is less humid than the air supply entering the system.

15. The system according to claim 9, wherein the liquid inlet of said first liquid side heat exchanger communicates with a cool liquid reservoir.

16. The system according to claim 9 wherein the liquid outlet of said second liquid side heat exchanger communicates with a cool liquid reservoir.

17. A refrigeration system using a refrigerant to transfer heat between air and a liquid, comprising:

a primary refrigerant loop including:

a refrigerant compressor, said refrigerant compressor having a suction refrigerant inlet and a compressed refrigerant outlet;

a reheat coil, said reheat coil having a refrigerant inlet and a refrigerant outlet;

a first flow-throttling valve, said first flow-throttling valve located between said refrigerant compressor outlet and said reheat coil inlet;

a first liquid side heat exchanger, said first liquid side heat exchanger having a refrigerant inlet and a refrigerant outlet, a liquid inlet, and a liquid outlet;

a second flow-throttling valve, said second flow-throttling valve located between said refrigerant compressor outlet and said first liquid side heat exchanger refrigerant inlet;

a head pressure control valve, said head pressure control valve capable of maintaining the outlet pressure of said refrigerant compressor above a preselected pressure limit;

a second liquid side heat exchanger, said second liquid side heat exchanger having a refrigerant inlet and a refrigerant outlet, a liquid inlet and a liquid outlet;

a first restrictor means, said first restrictor means regulating the flow of said refrigerant to said second liquid side heat exchanger;

an air side heat exchanger, said air side heat exchanger having a refrigerant inlet and a refrigerant outlet; and a second restrictor means, said second restrictor means regulating the flow of said refrigerant to the air side heat exchanger;

a first liquid loop including;

said first liquid side heat exchanger; and a second liquid loop including;

said second liquid side heat exchanger.

18. The system of claim 17 wherein the reheat coil and the air side heat exchanger are enclosed within a housing means.

19. The system of claim 18, wherein the housing means comprises an air blower, said air blower allowing for an air supply to flow over the air side heat exchanger and the reheat coil.

20. The system according to claim 17, wherein the air supply exiting the system has a higher temperature than the air supply entering the system.

21. The system according to claim 17, wherein the air supply exiting the system has a lower temperature than the air supply entering the system.

22. The system according to claim 17, wherein the air supply exiting the system is less humid than the air supply entering the system.

23. The system according to claim 17, wherein the first liquid side heat exchanger communicates with a cool liquid reservoir.

24. The system according to claim 17, wherein the second liquid side heat exchanger communicates with a warm liquid reservoir.

* * * * *